US006786163B2

(12) United States Patent
Kawasaki

(10) Patent No.: US 6,786,163 B2
(45) Date of Patent: Sep. 7, 2004

(54) AUTOMATED SEWING DEVICE

(75) Inventor: Kiyoshi Kawasaki, Tokyo (JP)

(73) Assignee: Tachi-S Co., Ltd., Tokyo (JP)

( * ) Notice: Subject to any disclaimer, the term of this patent is extended or adjusted under 35 U.S.C. 154(b) by 0 days.

(21) Appl. No.: 10/303,766

(22) Filed: Nov. 26, 2002

(65) Prior Publication Data

US 2003/0116069 A1 Jun. 26, 2003

(30) Foreign Application Priority Data

Nov. 26, 2001 (JP) ..... 2001-359540
Nov. 30, 2001 (JP) ..... 2001-365567

(51) Int. Cl.[7] ..... D05B 19/00; D05B 27/06; D05B 27/14

(52) U.S. Cl. ..... 112/470.07; 112/306; 226/17

(58) Field of Search ..... 112/470.07, 153, 112/306, 318, 322, 320; 271/227, 225, 251; 226/15, 17

(56) References Cited

U.S. PATENT DOCUMENTS 4,757,773 A * 7/1988 Nomura et al. ..... 112/153 X
5,544,602 A * 8/1996 Kawasaki ..... 112/470.09
5,626,091 A * 5/1997 Kobayashi ..... 112/470.07
5,899,159 A * 5/1999 Dasher et al. ..... 112/475.03

* cited by examiner

*Primary Examiner*—Peter Nerbun
(74) *Attorney, Agent, or Firm*—Browdy and Neimark

(57) ABSTRACT

An automated sewing device for automatically sewing together rectilinear and curved end portions respectively of two base materials. A guide element is provided to separate the two base materials from each other and guide them in a sewing direction, and a guide roller mechanism is provided, which operates to adjustingly bring one guide roller to contact with the base material having the curved end portion and rotate the guide roller to move that base material in a direction orthogonal with the sewing direction, thereby keeping the rectilinear and curved end portions in alignment with each other. Hence, a seam is created along the curved end portion with a constant margin given between the seam and the curved contour of the curved end portion. A pair of guide rollers may be provided to move two curved end portions in a direction orthogonal with the sewing direction for the same alignment purpose.

9 Claims, 7 Drawing Sheets

AUTOMATED SEWING DEVICE

BACKGROUND OF THE INVENTION

1. Field of the Invention

The present invention relates to an automated sewing device for automatically sewing an end of one material with an end of another material into a proper three-dimensional configuration of trim cover assembly that can be used for an automotive seat, a headrest and an armrest, wherein either of the two ends of those two materials includes a rectilinear and/or curved end portion.

2. Description of Prior Art

In general, a process for forming a three-dimensional trim cover assembly adapted to cover the outer surfaces of article for automobile, such as a seat, headrest and armrest, involves the sewing steps of sewing together two end portions respectively of two different shapes of cover base materials (e.g. cloth materials) by use of a sewing machine.

The end of each two different base materials includes a curved end portion, and therefore, it is difficult for a worker to precisely sew together the curved end portions because the worker should move the two base materials with his or her hands, using a long-experienced skill. Such time-consuming and troublesome manual steps has made the sewing process slow and inefficient. The same goes for the case where a rectilinear end of long tape of synthetic resin material is sewn with a curved end of a cloth base material.

To solve such problem, there has been known an automated sewing device for automatically sewing together the curved end portions of plural base materials. For example, the U.S. Pat. No. 5,544,602 (the corresponding Japanese Laid-Open Patent Publication No. 7-194870) discloses an automated sewing device comprising: a table having predetermined patterns of guide grooves formed therein; a guide plate having three guide rollers movably fitted in such guide grooves; a sewing machine; and an auxiliary feeding mechanism. According thereto, a first base material having a curved end portion, which is stored in the auxiliary feeding mechanism, is fed toward the sewing machine, while simultaneously, a second base material having a curved end portion, which is placed on the guide plate, is displaced at a proper angle towards a sewing point under the sewing machine, so that both two curved ends respectively of the first and second base materials are automatically sewn together at that sewing point.

However, the foregoing conventional automated sewing device has been found defective in that the structure thereof is quite complicated with high costs for assembly, and that it takes a lot of time to set the base materials in the corresponding guide plate and auxiliary feeding mechanism. Further, when each base material to be sewn together vary in shape, it is necessary to replace the table by another new one having suited patterns of guide grooves for sewing purpose. Furthermore, the arrangement of guide grooves and guide rollers makes it impossible to quickly and precisely sew together very small curved portions of the base materials.

SUMMARY OF THE INVENTION

In view of the above-stated drawbacks, it is a primary purpose of the present invention to provide an improvised automated sewing device which is simplified in structure and allows curved end portion(s) of the two base materials to be sewn together without requiring any other special element, regardless of whether the curved end portion is large or small in curvature.

In order to accomplish such purpose, the automated sewing device in accordance with the present invention is basically comprised of:

- a table;
- a sewing machine provided on the table, the sewing machine including a sewing needle and a feeding means, which are adapted to feed and sew together first and second base materials in a sewing direction;
- the table including a setting area where the first and second materials are to be set in proximity with the sewing needle;
- a control means for keeping both first and second end portions respectively of the first and second base materials in alignment with each other and supplying the thus-aligned first and second end portions toward the sewing machine, thereby causing the first and second base materials to be sewn together by the sewing machine along an outer contour of the aligned first and second end portions, with a seam created in the first and second base materials, so that a constant margin is given between the seam and outer contour, the control means including:
  - a control unit;
  - a sensor means electrically connected with the control unit, the sensor means being adapted to detect dislocation of either of the first and second end portions, such that, upon detecting such dislocation, the sensor means sends a detection signal to the control unit; and
  - a guide roller mechanism for guiding either of the first and second base materials in a direction orthogonal with the sewing direction in which the first and second base materials are sewn together by the sewing machine, the guide roller mechanism being electrically connected with the sensor means and including:
    - a guide means for separating the first base material from the second base material and guiding each of the first and second materials along the sewing direction;
    - a guide roller means;
    - a rotation drive means for causing rotation of the guide roller means; and
    - a transfer means for transferring the guide roller means toward and away from the setting area of table,
  - with such an arrangement that, responsive to a signal sent from the control unit which has received the detection signal, the guide roller mechanism is operated such that the transfer means works to transfer the guide roller means toward and away from the setting area, while at the same time, the rotation drive means works to cause rotation of the guide roller means in one of normal and reverse directions so as to cause displacement of either of the first and second base materials in the direction orthogonal with the sewing direction, whereby either of the first and second end portions is returned to a fixed point in said sensor means, whereby both first and second base materials are sewn together along the respective end portions thereof, with the constant margin given between the seam and the outer contours of the first and second end portions.

In one aspect of the present invention, the guide means may comprise a guide element extending toward the sewing needle of sewing machine, the guide element having a body of generally inverted-U-shaped cross-section and a through-hole defined therein, thereby allowing the first base material to be guided in and along the through-hole in the sewing direction, while allowing the second base material to be guided upon the body of the guide element in the sewing direction.

In another aspect of the present invention, the sensor means may comprise: a first sensor means adapted to detect dislocation of the first end portion of first base member; and a second sensor means adapted to defect dislocation of the second end portion of second base member. The guide means may be provided at the setting area on the table in proximity to the sewing needle, wherein the guide means includes a plate element having an upper surface defined above the table so that a space is defined between the upper surface and the table, thereby allowing the first base material to be guided within the space in the sewing direction, while allowing the second base material to be guided upon the upper surface of the plate element in the sewing direction. The first sensor means may be provided in the space, and the second sensor means be provided on the upper surface of the plate element. The rotation drive means may comprise: a first rotation motor connected with the first guide roller; and a second rotation motor connected with the second guide roller. The transfer means may comprise a first cylinder connected with the first rotation motor and a second cylinder connected with the second rotation motor. A hole may be formed in the table at the setting area in vicinity of the sewing needle. The first guide roller be disposed under said table and below said hole, and the second guide roller be disposed above the plate element.

Other various features and advantages will become apparent from reading of the descriptions hereinafter, with reference to the appended claims.

DETAILED DESCRIPTION OF PREFERRED EMBODIMENT OF THE INVENTION

Referring now to FIGS. 1 through 14, there is illustrated an automated sewing device, as generally designated by (SD), which is so designed to automatically sew a curved end portion of a first base material with a rectilinear or curved end portion of a second base material. Generically stated, in accordance with the present invention, there are provided a table (T), a sewing machine (M), and an end alignment control means (12) for keeping both curved or rectilinear end portions of the first and second base materials in alignment with each other and guiding them toward a sewing needle of the sewing machine (M), so that a constant margin is given between a seam (S) and the edges or outer contours of those end portions of the two base materials. It is noted that the end alignment control means (12), which will be described in two exemplary modes, is not limited to the illustrated embodiments, but may be embodied in any other desired ways within the gist and scopes of the present invention. Descriptions hereinafter are devoted to two exemplary embodiments, but, it should be understood that, as a common concept between the two embodiments, the end alignment control means (12) works under a computerized control using sensors so as to move the second base material (20) in a direction orthogonal with a rectilinear sewing direction (C) in which both first and second base materials (10) (20) are fed and sewn together by the sewing machine (M).

At first, reference is made to FIGS. 1 to 6 which illustrate a first embodiment of automated sewing device (SD).

In the present first mode, upon the table (T), there are provided the sewing machine (M) of conventional known type and the end alignment control means (12) stated above.

As is known, the sewing machine (M) has a sewing needle (M1), a pressure foot member (M2), and a feed dog member (not shown) provided in the table (T). Further explanation thereon is deleted for the sake of simplicity.

Figure 5:
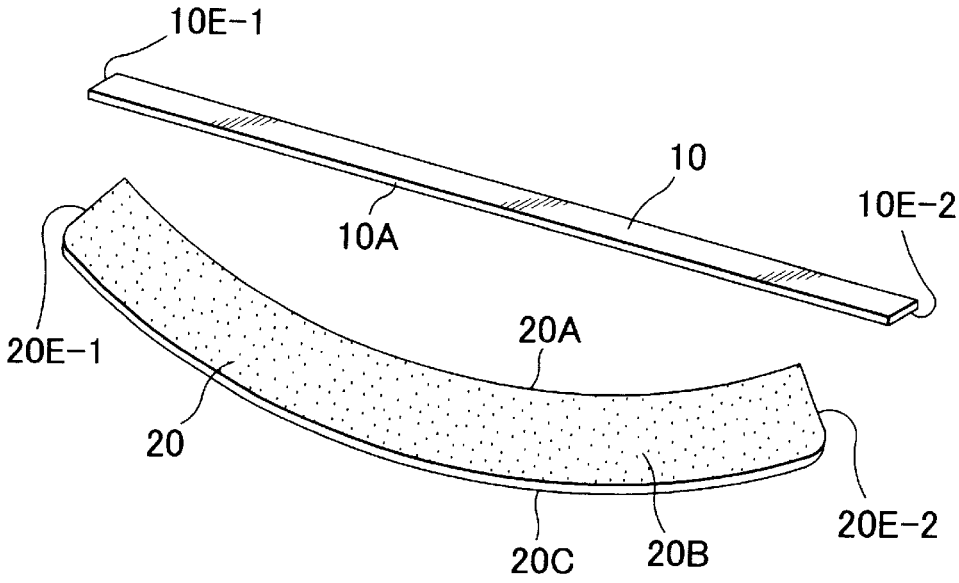
FIG. 5 is a perspective view showing a rectilinear first base material and a curved second base material, which are to be sewn together by the automated sewing device.

In this embodiment, as shown in FIG. 5, the first base material (10) may be a long tape of rectilinear synthetic resin material that can be sewn by the sewing needle (M1), whereas on the other hand, the second base material (20) be a curved cover material having a curved end portion (20A), for example. The second base material or curved cover material (20) is of two-layer lamination structure comprising a foam padding layer (20B) and a covering member layer (20C) (e.g. a fabric or a nonwoven fabric material) adhered to the foam padding layer (20B), which can be used as a part of trim cover assembly for use on a vehicle seat. Although not shown, the synthetic resin base material (10) may be a hook element of a generally "J" cross-section for engagement with another hook element sewn with another base material in assembly of a vehicle seat, as known in the art.

As illustrated, the end alignment control means (12) may be comprised of: a rectilinearly extending guide element (11); and a guide roller system including: a guide roller (3) having a serrated peripheral portion (30); a rotation drive means for causing normal and reverse rotation of said guide roller (3), which comprises a rotation motor (5) and a rotary shaft (31) horizontally extending from the motor (5); a transfer means for transferring said guide roller (3) vertically, which comprises a vertical cylinder (6) and a cylinder rod (6A) vertically extending from the cylinder (6); a sensor (4); a control unit (7); and a vertically extending end abutment member (M3). The control unit (7) is electrically connected with the rotation motor (5), the vertical cylinder (6) and the sensor (4) for a control purpose to be set forth later.

The guide element (11) may be a rectilinearly extending guide element of generally inverted-U-shaped cross-section having, defined therein, a rectilinearly extending through-hole (11H) in which the above-stated rectilinear synthetic resin material (10) may be movably inserted. As shown, such guide element (11) is fixed on the table (T) such that the first end (11E-1) thereof is disposed at one edge of the table (T), while the second end (11E-2) thereof is disposed in the proximity to the sewing point where the sewing needle (M1) and pressure foot member (M2) are situated. Hence, the guide element (11) extends rectilinearly from the edge of table (T) to such sewing point.

It is seen that the guide roller (3) and guide element (11) are disposed at a setting area on the table (T) where the first and second base materials (10) (20) are to be set and sewn by the sewing machine (M) in the sewing direction (C).

The vertical cylinder (6) is fixedly mounted on a bracket (9) fixed to the table (T) in a manner dependent therefrom. The lower rod (6B) of the cylinder (6) is fixed on that bracket (9). Designation (6C) denotes a mount plate on which the rotation motor (5) is fixedly mounted. The upper rod (6A) of the motor (6) is fixed to such mount plate (6C). As best shown in FIG. 2, the vertical cylinder (6) is disposed under the table (T), while the rotation motor (5) is positioned at a level above the table (T), so that the rotary shaft (31) of the latter (5) extends horizontally above the table (T) at a length smaller than the length of the guide element (11), with the guide roller (3) being positioned in the vicinity of both sewing needle (M1) and guide element second end (11E-2). Normally, as shown in FIGS. 1 and 2, both guide roller (30) and rotary shaft (31) extend alongside of the guide element (11) in parallel therewith.

Figure 3:
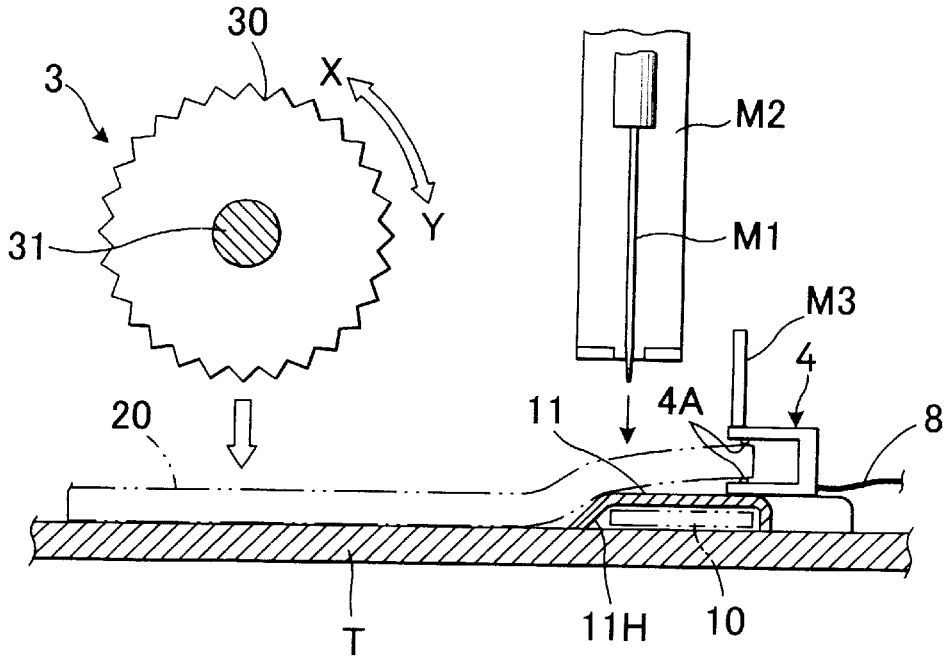
FIG. 3 is a sectional view showing a principal part of the automated sewing device.

The sensor (4) is a known optical sensor comprising a frame of channel cross-section whose opening side faces to the side where the guide roller (3) and rotary shaft (31) lies, as can be seen from the figures. This sensor (4) is electrically connected via a cable (8) with the control unit (7) which contains a computer, control circuits and other required electronic components, though not shown. Designations (4A) (4A) denote a pair of optical detection elements (e.g. a light emitter element and a light receiver element), respectively. Those two optical detection elements (4A) are fixed on the upper and lower horizontal walls of the sponsor (4), respectively, as best shown in FIG. 3. Such upper and lower horizontal walls are so spaced from each other as to allow the curved end portion (20A) of the second base material (20) to be movably received therein. The two detecting elements (4A) work to detect a minute horizontal dislocation of that curved end portion (20A) from a fixed point in a direction substantially orthogonal with the sewing direction (C), and send a corresponding signal via the cable (8) to the control unit (7).

Figure 1:
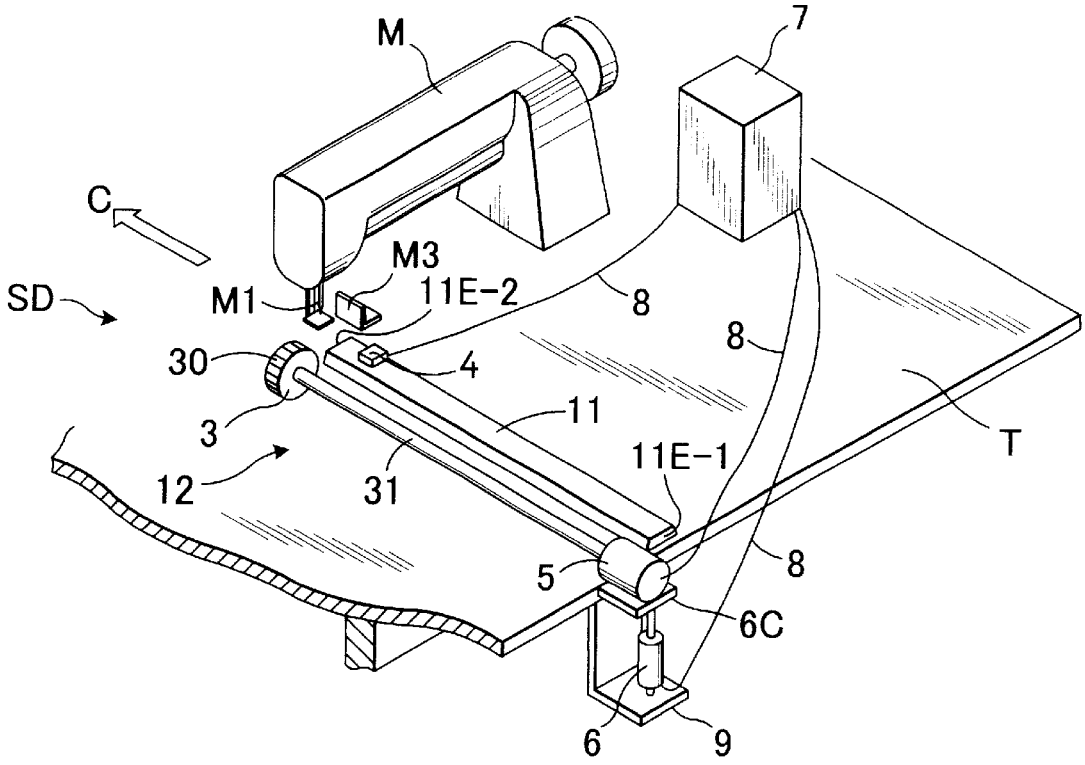
FIG. 1 is a partly broken schematic perspective view of a first mode of automated sewing device in accordance with the present invention.
Figure 2:
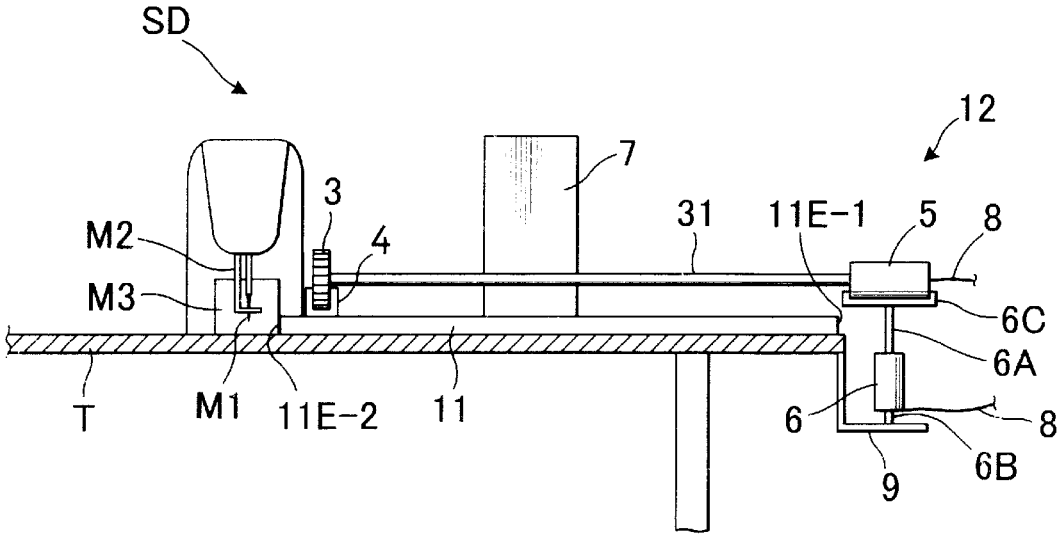
FIG. 2 is a sectional view of the automated sewing device as in FIG. 1.

Further, both two motors (5) (6) are electrically connected with the control unit (7), as shown in FIG. 1. Upon receipt of the signal from the sensor (4), the control unit (7) sends an appropriate instruction signal to each of the two motors (5) (6) which in turn works as will be described later.

The end abutment guide member (M3) is fixed on the table (T) in the vicinity of the guide element end (11E-2) and behind the sewing needle (M1), as in FIG. 1, and provides a vertical surface which is substantially aligned with the two optical detection elements (4A) of sensor (4), as best shown in FIG. 3.

Now, description will be made of operation of the above-described automated sewing device, with particular reference to FIGS. 3, 4, 5, 6 and 13.

At first, the rectilinear synthetic resin material or the first base material (10) is inserted through the through-hole (11H) of the guide element (11) from the first end (11E-1) of the same (11), by inserting one end (10E-1) of the first base material (10) thereinto and projecting the same out of the second end (11E-2) of the guide element (11) to a point right below the sewing needle (M1). Thereafter, the curved second base material (20) is turned over to show up its reverse side or the foam padding layer side (at 20B) as in FIG. 13, and is placed upon both guide element (11) and table (T) and disposed under the guide roller (3), such that the end (20E-1) of the second base material (20) is aligned with the end (10E-1) of the first base material (10) and also the curved end portion (20) is inserted partway in the opening side of the sensor (4), as can be seen from FIGS. 3, 4 and 13. At this point, both rotation motor (5) and rotary shaft (31) are retained by the vertical cylinder (6) at a level where the guide roller (3) is positioned above and out of contact with the foam padding layer side (at 20B) of second base material (20). Then, upon turning on a switch (not shown), the sewing machine (M) is operated to start sewing together the first and second base materials (10) (20) along their respective end portions (10A) and (20A) in a direction from the first ends (10E-1) (20E-1) thereof to the second ends (10E-2) (20E-2) thereof.

Figure 4:
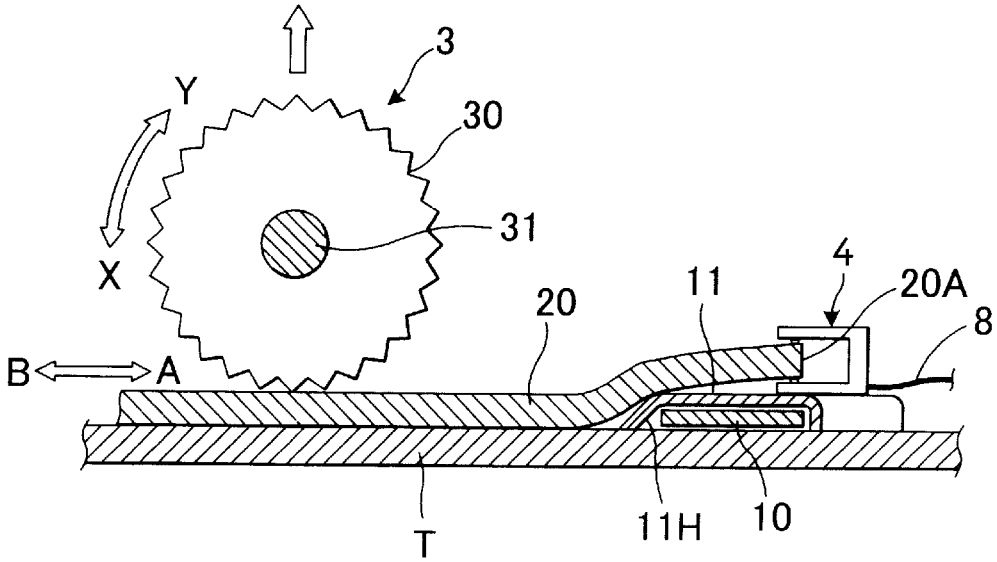
FIG. 4 is a diagram which explanatorily shows operation of the principle part of the automated sewing device.

During the sewing operation, the curved end portion (20A) of second base material (20) is naturally dislocated from a fixed point of the sensor (4) or in a direction toward and away from the sensor (4). In other words, as both two base materials (10) (20) are fed by the sewing machine (M) in the rectilinear sewing direction (C), the curved end portion (20A) is naturally dislocated to the innermost inside of the sensor (4) and in a direction away from the sensor (4). As viewed from FIG. 4, upon detecting inward movement of the curved end portion (20A) toward its innermost inside, the sensor (4) sends a signal to the control unit (7) which in turn quickly sends a signal to the vertical cylinder (6), instructing it to lower its rod (6A) as indicated by the downward arrow of FIG. 3, whereupon the cylinder (6) lowers its rod (6A) so as to displace both rotation motor (5) and rotary shaft (31) downwardly, thereby bringing the serrated peripheral portion (30) of guide roller (3) to contact (precisely stated, a frictional contact) with the foam padding layer side (20B) of second base material (2), as shown in FIG. 4. Simultaneous therewith, a signal is sent from the control unit (7) to the rotation motor (5) so as to cause clockwise rotation of the rotary shaft (31) to rotate the guide roller (3) in the clockwise direction as indicated by the arrow (Y), whereupon the second base material (20) is moved in the arrow direction (B) away from the sensor (4) to return the second base material end portion (20A) to a fixed point in the sensor (4). Then, as soon as the edge of that end portion (20A) is returned to the fixed point, the sensor (4) immediately sends a signal to the control unit (7). Responsive thereto, the control unit (7) sends an instruction signal to the rotation motor (5) to quickly stop rotation of both rotary shaft (31) and guide roller (3) while sending a signal to the vertical cylinder (6) so as to quickly cause the cylinder rod (6A) to extend upwardly to raise the guide roller (3) to a point out of contact with the second base material (20) as indicated by the upward arrow in FIG. 4, thereby allowing smooth movement of the second base material (20) for sewing with the first base material (10). In this respect, the vertical surface of the end abutment guide member (M3) serves to keep the two ends (10A) (20A) respectively of first and second base materials (10) (20) in alignment with each other and guide both two base materials (10) (20) to the sewing needle (M1) so that a constant margin is given between the seam (S) and the edges of those two end portions (10A) (20A).

Likewise, during the sewing operation, the sensor (4) also keeps to detect outward movement of the second base material curved end portion (20A) away therefrom. Upon detection of such outward movement, the sensor (4) sends a signal to the control unit (7) which in turn quickly sends a signal to the vertical cylinder (6), instructing it to lower its rod (6A), so that both rotation motor (5) and rotary shaft (31) are displaced downwardly, thereby bringing the serrated peripheral portion (30) of guide roller (3) to contact (precisely stated, a frictional contact) with the foam wadding layer side (at 20B) of second base material (2), as in FIG. 4. Simultaneous therewith, a signal is sent from the control unit (7) to the rotation motor (5) so as to cause anticlockwise rotation of the rotary shaft (31) to rotate the guide roller (3) in the anticlockwise direction as indicated by the arrow (X), whereupon the second base material (20) is moved in the arrow direction (A) toward the sensor (4) to return the second base material end portion (20A) to a fixed point in the sensor (4). Then, as soon as the edge of that end portion (20A) is returned to the fixed point, the sensor (4) immediately sends a signal to the control unit (7). Responsive thereto, the control unit (7) sends an instruction signal to the rotation motor (5) to quickly stop rotation of both rotary shaft (31) and guide roller (3) while sending a signal to the vertical cylinder (6) so as to quickly cause the cylinder rod (6A) to extend upwardly to raise the guide roller (3) to a point out of contact with the second base material (20) as indicated by the upward arrow in FIG. 4, thereby allowing smooth movement of the second base material (20) for sewing with the first base material (10).

Figure 6:
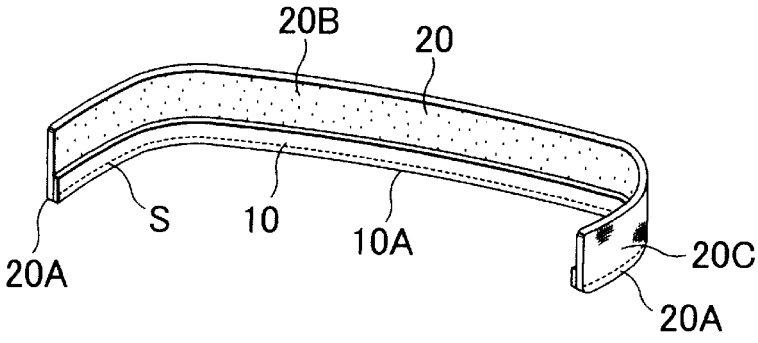
FIG. 6 is a perspective view showing a resulting sewn product which is created by sewing together the first and second base materials through the automated sewing device.

In that way, the first and second base materials (10) (20) are sewn together along their respective end portions (10A) (20A) into such generally "U" shaped configuration as shown in FIG. 6.

Reference is made to FIGS. 7 to 12 which illustrates a second alternative mode of automated sewing device (SD).

Figure 11:
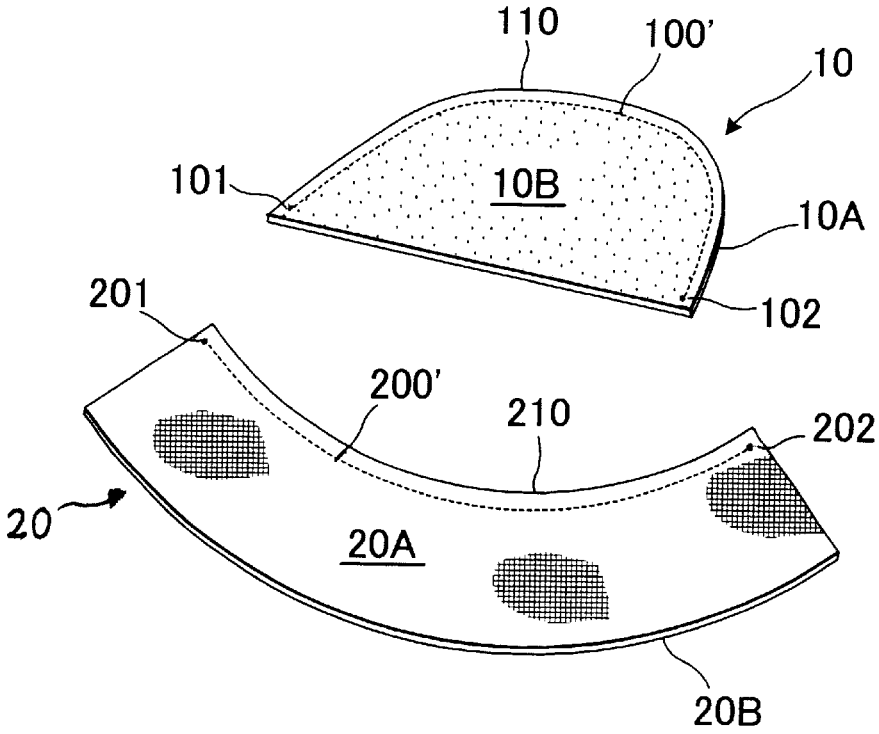
FIG. 11 is a perspective view showing a first base material having a convexly curved end portion and a second base material having a concavely curved end portion.

As suggested in FIG. 11, there is the case where the first base material (10) has a concavely curved end portion (110) and the second base material (20) has a convexly curved end portion (210), wherein, of course, both two base materials (10) (20) may be used as a part of trim cover assembly for use on a vehicle seat. The present second mode of automated sewing device (SD) is therefore designed to sew together such concavely and convexly curved end portions (110) (210) respectively of the first and second base materials (10) (20), with a constant margin given between a seam (S) and the outer contours of those two end portions (110) (210).

As similar to the aforementioned first embodiment, upon the table (T), there are provided a sewing machine (M) of conventional known type, a guide plate element (49) disposed in the proximity to the sewing machine (M), the end alignment control means (12), and an end abutment guide member (M3).

The sewing machine (M) has a sewing needle (M1), a pressure foot member (M2), and a feed dog member (not shown) provided in the table (T). Further explanation thereon is deleted for the sake of simplicity.

Figure 9:
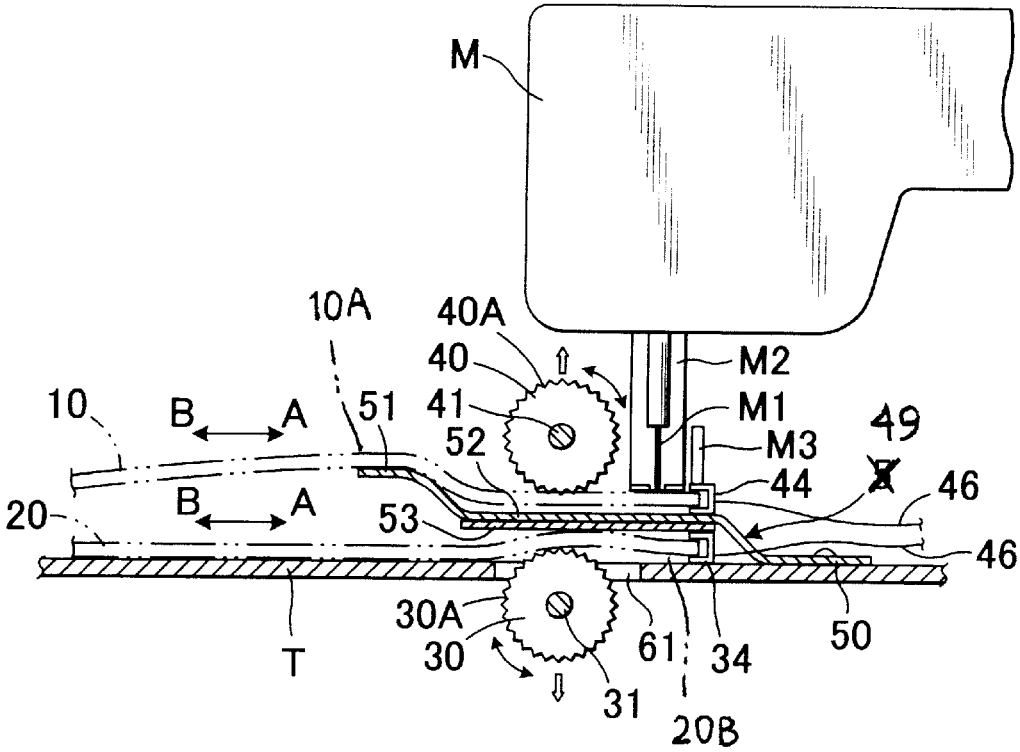
FIG. 9 is a sectional view showing a principal part of the second mode of automated sewing device.

As best shown in FIG. 9, the guide plate element (49) is formed by bending a plate material to define therein a horizontally expanding securing end portion (50), a horizontally expanding raised portion (52) and an upwardly ridged free end portion (51). The securing end portion (50) is fixedly fastened on the upper surface of table (T) at a right-hand side from the sewing needle (M1), as viewed from FIG. 9, so that the raised portion (52) extends above the table (T) in parallel therewith toward a left-hand side from the sewing needle (M1) and terminates in such upwardly ridged free end portion (51). Designation (53) denotes a reinforcement plate fixed to the reverse side of the raised portion (52) to reinforce the latter.

As shown in FIG. 11, the first base material (10) is of a two-layer lamination structure comprising a foam padding layer (10B) and a covering member layer (10A) (e.g. a fabric or nonwoven fabric material). On the other hand, the second base material (20) is also of a two-layer lamination structure comprising a foam padding layer (20B) and a covering member layer (20A) (e.g. a fabric or nonwoven fabric material).

As illustrated, the end alignment control means (12) may be comprised of a rectilinearly extending guide element (11) and a guide roller system (12).

In the guide roller system (12) of the present mode, a control unit (48) is provided, which contains a computer, control circuits and other required electronic components, though not shown, and a pair of first and second guide rollers (30) (40) are provided below and above the table (T), respectively, for the purpose of adjustingly move the first and second base materials (10) (20), respectively, in a direction orthogonal with the sewing direction (C).

Figure 8:
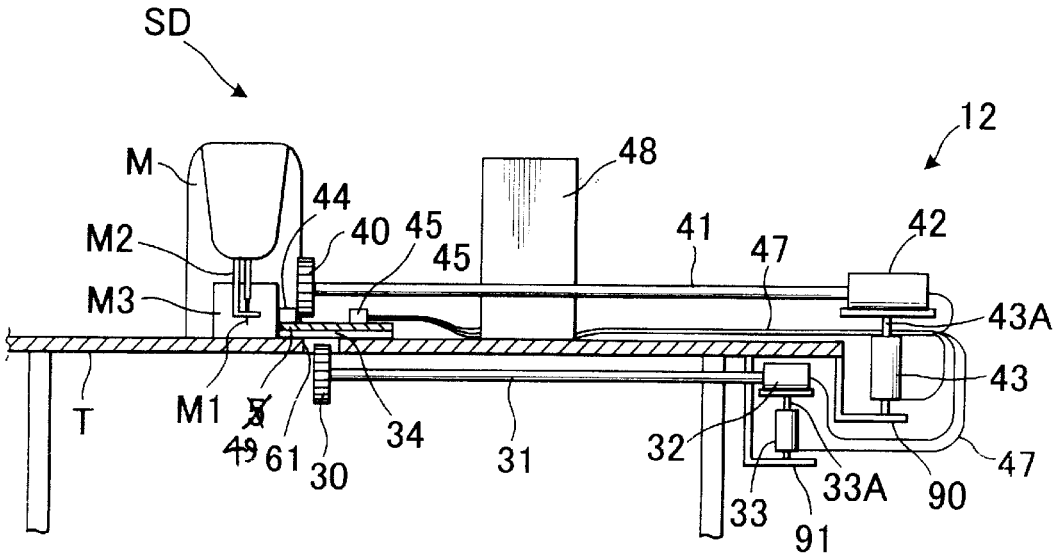
FIG. 8 is a sectional view taken along the line VIII—VIII in FIG. 7.

With regard to the first guide roller (30), it has a serrated peripheral portion (30A) (see FIG. 9) and is disposed below the table (T). The associated mechanism of the first guide roller (30) comprises: one sensor (34) disposed on the table (T) and under the guide plate element (49); a transfer means transferring the first guide roller (30) vertically, which comprises a vertical cylinder (33) and a cylinder rod (33A) vertically extending from the cylinder (33); and a rotation drive means for causing normal and reverse rotation of the guide roller (30), which comprises a rotation motor (32) and a rotary shaft (31) horizontally extending from the motor (32), wherein the vertical cylinder (33) and rotation motor (32) are electrically connected, via their respective cables (47), with the control unit (48). The first guide roller (30) is fixed on the free end of the rotary shaft (31) and normally positioned below a hole (61) formed in the table (T), as shown in FIG. 8. As best seen from FIG. 8, the vertical cylinder (33) is fixedly mounted on a bracket (91) fixed to the table (T) in a manner dependent therefrom. The vertical cylinder (33) has a vertically extending rod (33A) on which the rotation motor (32) is fixed via a bracket, as shown. The rotary shaft (31) of the rotation motor (30) extends horizontally in parallel with the bottom or reverse side of the table (T), terminating in a free end on which the first guide roller (30) is fixed, the guide roller (30) being disposed at the hole (61) in the vicinity of the sewing needle (M1).

It is seen that the two guide rollers (30) (40) and partition guide plate (11) are disposed at a setting area on the table (T) where the first and second base materials (10) (20) are to be set and sewn by the sewing machine (M) in the sewing direction (C).

Figure 10:
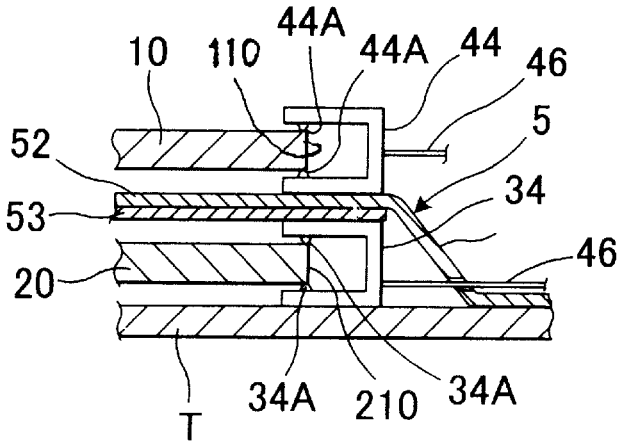
FIG. 10 is a fragmentary sectional view showing sensors and end portions of first and second base materials.

The sensor (34) is a known optical sensor comprising a frame of channel cross-section whose opening side faces to the side where the guide roller (33) and rotary shaft (31) lie, as best from FIG. 9. This sensor (34) is electrically connected via a cable (46) with the control unit (48). Designations (34A) (34A) denote a pair of optical detection elements (e.g. a light emitter element and a light receiver element), respectively. Those two optical detection elements (34A) are fixed on the upper and lower horizontal walls of the sensor (34), respectively, as best shown in FIG. 10. Such upper and lower horizontal walls are so spaced from each other as to allow the concavely curved end portion (210) of the second base material (20) to be movably received therein. The two detection elements (34A) work to detect a minute horizontal dislocation of that end portion (210) from a fixed point in a direction substantially orthogonal with the sewing direction (C) and send a corresponding electrical signal via the cable (46) to the control unit (48).

On the other hand, the second guide roller (40) having a serrated peripheral portion (40A) (see FIG. 9) is disposed below the table (T). The associated mechanism of the second guide roller (40) comprises: a pair of first and second sensors (44) (45) fixedly provided on the upper surface of the of partition guide plate raised portion (52); a transfer means for transferring the guide roller (40) vertically, which comprises a vertical cylinder (43) and a cylinder rod (33A) vertically extending from the cylinder (43); and a rotation drive means for causing normal and reverse rotation of the guide roller (40)), which comprises a rotation motor (42) and a rotary shaft (41) horizontally extending from the motor (42), wherein the vertical cylinder (43) and rotation motor (42) are electrically connected, via their respective cables (47), with the control unit (48). As shown in FIG. 9, the second guide roller (40) is fixed on the free end of the rotary shaft (41) and normally positioned at a level above the guide plate element raised portion (52).

As best seen from FIG. 8, the vertical cylinder (43) is fixedly mounted on a bracket (90) fixed to table (T) and situated at a level above the foregoing rotation motor (32) associated with the first guide roller (30). The vertical cylinder (43) has a vertically extending rod (43A) on which the rotation motor (32) is fixed via a bracket, as shown. The rotary shaft (41) of the rotation motor (42) extends horizontally in parallel with the upper flat surface of the table (T), terminating in the second guide roller (40) which is disposed above the partition guide plate raised portion (52) in the vicinity of the sewing needle (M1). Each of the first and second sensors (44) (45) is a known optical sensor comprising a frame of channel cross-section whose opening side faces to the side where the second guide roller (40) and rotary shaft (41) lie, as seen from FIG. 7. Both two sensors (44) (45) are electrically connected, via the corresponding two cables (46), with the control unit (48). As best shown in FIG. 10, the first sensor (44) has a pair of optical detection elements (44A) (44A) (e.g. a light emitter element and a light receiver element) fixed on the respective upper and lower walls thereof. While not shown, likewise as in such first sensor (44), the second sensor (45) has a pair of optical detection elements fixed on the respective upper and lower horizontal walls thereof. Such upper and lower horizontal walls are so spaced from each other as to allow the convexly curved end portion (110) of the first base material (10) to be movably received therein. The two detection elements work to detect a minute horizontal dislocation of such end portion (110) from a fixed point in a direction substantially orthogonal with the sewing direction (C) and send a corresponding electrical signal via the cable (46) to the control unit (48).

Figure 7:
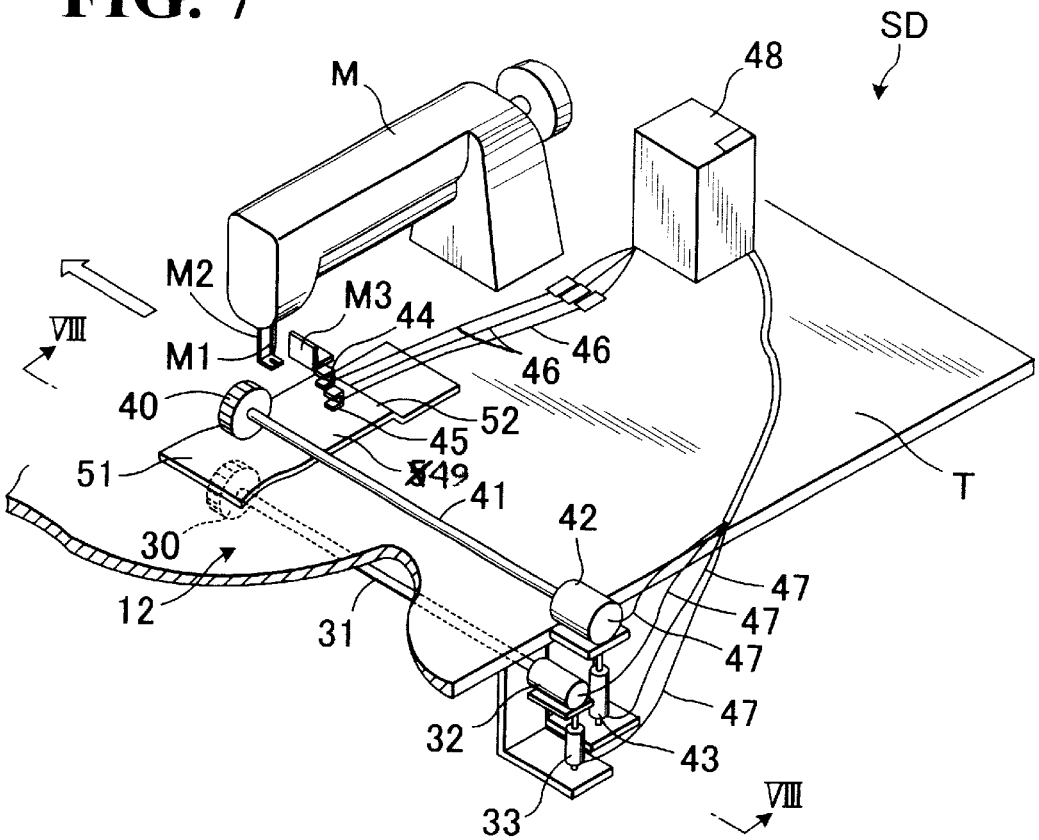
FIG. 7 is a partly broken schematic perspective view of a second alternative mode of automated sewing device in accordance with the present invention.

As shown in FIGS. 7 to 10 and 14, the end abutment guide member (M3) is disposed on the table (T) in the vicinity of the guide plate element (49) and behind the sewing needle (M1), as in FIG. 7, and provides a vertical guide surface which is substantially alignment with the two optical detection elements (34A) of sensor (34) as well as with the two optical detection elements (44A) of first sensor (44), as understandable from FIGS. 9 and 10.

Further, as understandable from FIGS. 9 and 10, the first sensor (44) is disposed on the guide plate element raised portion (52) at a point near to the sewing needle (M3), such that the two optical detection elements (44A) are substantially in alignment with the vertical guide surface of the abutment guide member (M3). On the other hand, the second sensor (45) is disposed on the guide plate element raised portion (52) at a point spaced apart from the first sensor (44) and dislocated therefrom to the side near to the rotary shaft (41). Such arrangement of two sensors (44) (45) provides an effective two-point detection for the convexly curved end portion (110) of first base material (10).

Figure 14:
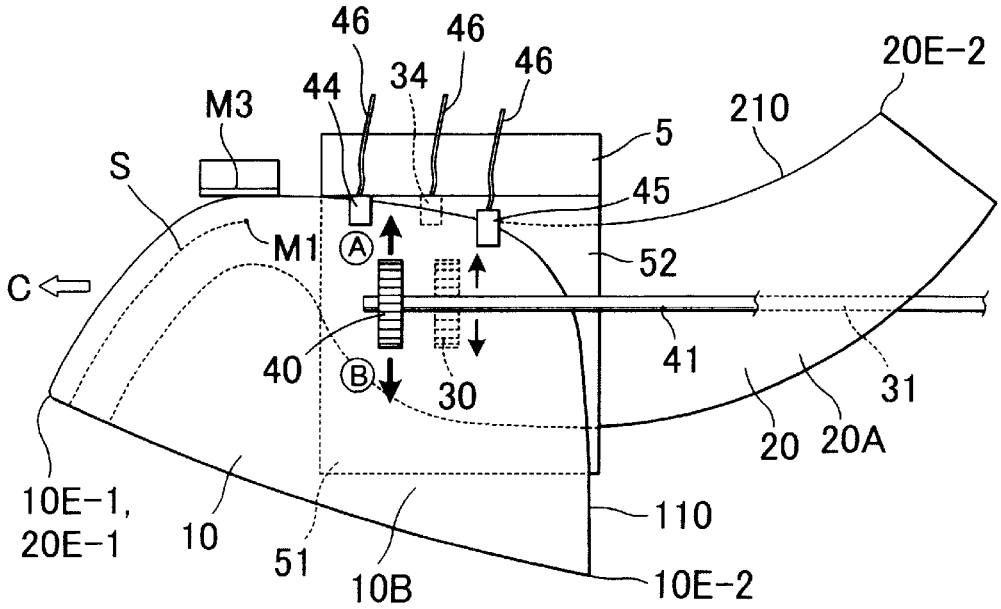
FIG. 14 is a diagram showing the automatic sewing of a first base material having a concavely curved end portion with a second base material having a convexly curved end portion.

As can be seen in FIG. 14, the sensor (34) is situated at midway point between the first and second sensors (44) (45).

Now, description will be made of operation of the above-described automated sewing device, with reference to FIGS. 7 to 12 and 14.

At first, the second base material (20) is placed on the table (T), with the covering member layer side (at 20A) turned upside as in FIG. 11, and then inserted into a guide space defined between the table (T) and the horizontally extending raised portion (52) of guide plate element (49), so that one end (20E-1) of the first base material (20) is positioned at a point right under the sewing needle (M1). Care should be taken to insure inserting the concavely curved end portion (210) of second base material (20) in the opening side of the sensor (34). At this point, both rotation motor (32) and rotary shaft (31) are retained by the vertical cylinder (33) at a level where the first guide roller (40) is positioned below the hole (61) and out of contact with the foam padding layer side (20B) of the second base material (20).

Thereafter, the first base material (10) is turned over to show up its reverse side or the foam padding layer side (at 10B) as in FIG. 11 and is placed upon the guide plate element (49) and disposed under the second guide roller (40), such that the end (10E-1) of the first base material (10) is aligned with the end (20E-1) of the second base material (20) and also the convexly curved end portion (110) is inserted in the opening side of the first sensor (44) and also inserted in the opening side of the second sensor (45), as can be seen from FIGS. 9, 10, 11 and 14. At this point, both rotation motor (42) and rotary shaft (41) are retained by the vertical cylinder (43) at a level where the second guide roller (40) is positioned above and out of contact with the foam padding layer side (at 10B) of the first base material (10).

Then, upon turning on a switch (not shown), the sewing machine (M) is operated to start sewing together the first and second base materials (10) (20) along their respective curved end portions (110) and (210) from their respective sewing start points (101) (201) (see FIG. 11), so that sewing is effected along the curved or arcuate sewing path indicated by the dotted lines (110) (210) in FIG. 11, as will explained below.

During the sewing operation, the concavely curved end portion (210) of second base material (20) is naturally displaced from a fixed point of the sensor (34) or in a direction toward and away from the sensor (4). In other words, as both two base materials (10) (20) are fed by the sewing machine (M) in the rectilinear sewing direction (C), the concavely curved end portion (210) is naturally moved to the innermost inside of the sensor (34) or moved outwardly in a direction away from the same (34). As viewed from FIG. 9, upon detecting inward movement of the curved end portion (210) toward its innermost inside, the sensor (34) sends a signal to the control unit (48) which in turn quickly sends a signal to the vertical cylinder (33), instructing it to raise its rod (33A) upwardly so as to raise both rotation motor (32) and rotary shaft (31), thereby bringing the serrated peripheral portion (30A) of guide roller (30) to contact (precisely stated, a frictional contact) with the foam padding layer (20B) of second base material (2), as indicated in FIG. 9. Simultaneous therewith, a signal is sent from the control unit (48) to the rotation motor (32) so as to cause anticlockwise rotation of the rotary shaft (31) to rotate the first guide roller (30) in the anticlockwise direction, whereupon the second base material (20) is moved in the arrow direction (B) away from the sensor (34) to return the concavely curved end portion (210) to a fixed point in the sensor (34). Then, as soon as the edge of that end portion (210) is returned to the fixed point, the sensor (34) immediately sends a signal to the control unit (48). Responsive thereto, the control unit (48) sends an instruction signal to the rotation motor (32) to quickly stop rotation of both rotary shaft (31) and guide roller (30) while sending a signal to the vertical cylinder (33) so as to quickly cause the cylinder rod (33A) to withdraw downwardly to lower the guide roller (30) to a point out of contact with the second base material (20) as indicated by the downward arrow in FIG. 9, thereby allowing smooth movement of the second base material (20) for sewing with the first base material (10).

Likewise, during the sewing operation, the sensor (34) also keeps to detect outward movement of the second base material end portion (210) away therefrom. Upon detection of such outward movement, the sensor (34) sends a signal to the control unit (48) which quickly sends a signal to the vertical cylinder (33), instructing it to raise its rod (33A) so as to displace both rotation motor (32) and rotary shaft (31) upwardly, thereby bringing the serrated peripheral portion (30A) of first guide roller (30) to contact (precisely state, a frictional contact) with the foam wadding layer (20B) of second base material (2). Simultaneous therewith, a signal is sent from the control unit (48) to the rotation motor (32) so as to cause clockwise rotation of the rotary shaft (31) to rotate the first guide roller (30) in the anticlockwise direction, whereupon the second base material (20) is moved in the arrow direction (A) toward the sensor (34) to return the second base material end portion (210) to a fixed point in the sensor (34). Then, as soon as the edge of that end portion (210) is returned to the fixed point, the sensor (34) immediately sends a signal to the control unit (48). Responsive thereto, the control unit (48) sends an instruction signal to the rotation motor (32) to immediately stop rotation of both rotary shaft (31) and guide roller (30), while sending a signal to the vertical cylinder (33) so as to quickly withdraw its cylinder rod (33A) downwardly, thereby lowering the first guide roller (30) to a point out of contact with the second base material (20) and allowing smooth movement of the second base material (20) for sewing with the first base material (10).

On the other hand, simultaneous with the above-described controlled operation of the first guide roller (30), the convexly curved end portion (110) of first base material (10) is also naturally displaced from a fixed point in each of the first and second sensors (44) (45) (i.e. in a direction toward and away from those two sensors (44) (45)). As viewed from FIG. 9, when the convexly curved end portion (110) is moved toward the innermost inside of either the first sensor (44) or the second sensor (45), each of the first and second sensors (44) (45) detects such inward movement, and sends a signal to the control unit (48) which in turn quickly sends a signal to the vertical cylinder (43), instructing it to move its rod (43A) downwardly so as to lower both rotation motor (42) and rotary shaft (41), thereby bringing the serrated peripheral portion (40A) of second guide roller (40) to contact (precisely stated, a frictional contact) with the foam padding layer (10B) of first base material (10), as indicated in FIG. 9. At the same time, a signal is sent from the control unit (48) to the rotation motor (42) so as to cause clockwise rotation of the rotary shaft (41) to rotate the first guide roller (40) in the clockwise direction, whereupon the first base material (10) is moved in the arrow direction (B) away from the first and second sensors (44) (45) to return the convexly curved end portion (110) to a fixed point in each of the two sensor (44) (45). Then, as soon as the edge of that end portion (110) is returned to the fixed point, each of the two sensor (44) (45) immediately sends a proper signal to the control unit (48). Responsive thereto, the control unit (48) sends an instruction signal to the rotation motor (42) to immediately stop rotation of both rotary shaft (41) and second guide roller (40), while sending a signal to the vertical cylinder (43) so as to quickly raise its cylinder rod (43A) to bring the second guide roller (40) to a point out of contact with the first base material (10) as indicated by the upward arrow in FIG. 9, thereby allowing smooth movement of the first base material (10) for sewing with the second base material (20).

Likewise, during the sewing operation, the first and second sensors (44) (45) also keep to detect outward movement of the first base material end portion (110) away therefrom. Upon detection of such outward movement, each of the first and second sensors (44) (45) sends a signal to the control unit (48) which quickly sends a signal to the vertical cylinder (43), instructing it to lower its rod (43A) to displace both rotation motor (42) and rotary shaft (41) downwardly, thereby bringing the serrated peripheral portion (40A) of second guide roller (40) to contact (precisely stated, a frictional contact) with the foam wadding layer side (10B) of second base material (10). Simultaneous therewith, a signal is sent from the control unit (48) to the rotation motor (42) so as to cause anticlockwise rotation of the rotary shaft (41) to rotate the second guide roller (40) in the anticlockwise direction, whereupon the first base material (10) is moved in the arrow direction (A) toward each of the first and second sensors (44) (45) to return the first base material end portion (110) to a fixed point in each of the two sensors (44) (45). Then, as soon as the edge of that end portion (110) is returned to the fixed point, both two sensors (44) (45) immediately send their own signals to the control unit (48). Responsive thereto, the control unit (48) sends an instruction signal to the rotation motor (42) to quickly stop rotation of both rotary shaft (41) and second guide roller (40), while sending a signal to the vertical cylinder (43) so as to quickly cause the cylinder rod (33A) to withdraw upwardly to raise the second guide roller (40) to a point out of contact with the first base material (10), thereby allowing smooth movement of that first base material (10) for sewing with the second base material (20).

In this respect, the vertical surface of the abutment guide member (M3) serves to keep the two end portions (110) (210) respectively of first and second base materials (10) (20) in alignment with each other, thereby guiding the two base materials (10) (20) toward the sewing needle (M1) so that a constant margin is given between the seam (S) and the outer contours of those two end portions (110) (210).

Figure 12:
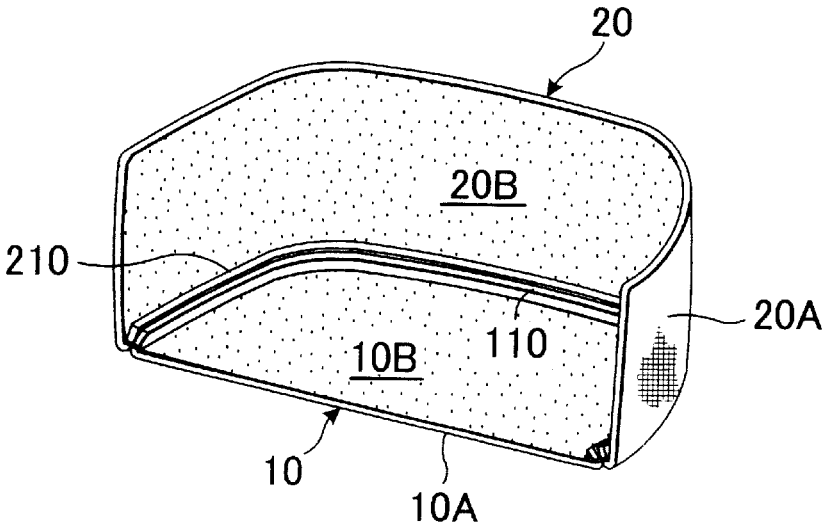
FIG. 12 is a perspective view showing a resulting sewn product which is created by sewing together the first and second base materials through the automated sewing device.
Figure 13:
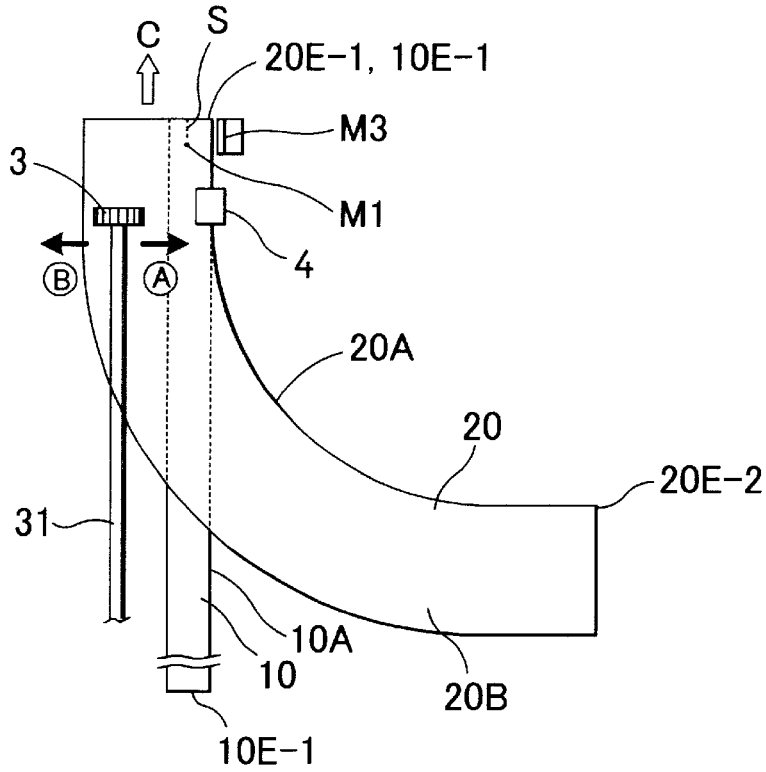
FIG. 13 is a diagram showing the automatic sewing of a rectilinear portion of a first base material to a curved end portion of a second base material.

In that way, the first and second base materials (10) (20) are sewn together along their respective convexly and concavely curved end portions (110) (210) as indicated by the dotted lines (110') and (200') in FIG. 11. The thus-sewn resulting product is finally turned over into such final three-dimensional sewn product as shown in FIG. 12, wherein all the foam padding layer side (at 10B and 20B) are situated inwardly of the final product, with all the covering member layer side (at 10A and 20A) facing outwardly thereof.

It is noted that, even in this embodiment, a second base material (20) having a rectilinear end portion, like the first embodiment, can be sewn with the convexly curved end portion (110) of first base material (10), in which case, the first guide roller (30) should be removed from the rotary shaft (31) and the related sensor (34) be removed from the table (T). This is however an easy and simple procedure.

From the foregoing descriptions on all the first and second embodiments, it is appreciated that the present invention has the following advantages and effects.

(i) The guide roller (3) or each of the two guide rollers (30, 40) may be made small in diameter and located at a point adjacent to the sewing needle (M1) of sewing machine (M). Hence, each of those guide rollers can be quickly moved vertically by the corresponding vertical cylinder (6, 33 or 43) and quickly rotated by the corresponding rotation motor (5, 32, or 42), thereby realizing minute vertical and rotational motions of the guide roller (s) responsive to an instruction signal sent from the control unit (7 or 48) which works responsive to the sensor (4) or sensors (34, 44 and 45). Thus, it is possible to precisely guide both two end portions (10A and 20B, or 110 and 210) of the first and second base materials (10, 20) with respect to the sewing needle (M1), even if the sewing speed of the sewing machine (M) is high, so as to create a seam (S) along the curvature of the curved end portion (20B) or the two different curved end portions (110) (210), with a constant margin given between the seam (S) and the outer contours of those curved end portions. In other words, such precise guiding control can be effected to any small curved end portions of base materials, each of which has a very small curvature.

(ii) The simple combination of guide roller (s) and sensor (s) with respect to the sewing point at the sewing needle (M1) effectively works to sew together any rectilinear or curved shapes of both two end portions respectively of the first and second base materials (10) (20) with a predetermined margin left between a seam and the edge of the two end portions. Therefore, there is no need to provide any other special mechanism and elements than those guide roller(s) and sensor(s), depending on each different shape of the end portion of base material to be sewn by the sewing machine (M).

(iii) Both two base materials (10) (20) can be quickly and easily set on a predetermined position on the table (T) without any retainer or other setting elements.

Finally, it should be understood that the present invention is not limited to the illustrated embodiments, but any other modification, replacement and addition may be applied thereto without departing from the scopes of the appended claims.

What is claimed is:

1. An automated sewing device for automatically sewing a first end portion of a first base material with a second end portion of a second base material, comprising:

a table;

a sewing machine provided on said table, said sewing machine including a sewing needle and a feeding means, said sewing needle and feeding means being adapted to feed and sew together said first and second base materials in a sewing direction;

said table including a setting area where said first and second base materials are to be set in vicinity of said sewing needle;

a control means for keeping said first and second end portions respectively of said first and second base materials in alignment with each other and supplying the thus-aligned first and second end portions toward said sewing machine, thereby causing said first and second base materials to be sewn together by said sewing machine along an outer contour of said aligned first and second end portions, with a seam created in the first and second base materials, so that a constant margin is given between said seam and said outer contour, said control means including:

a control unit;

a sensor means electrically connected with said control unit, said sensor means being adapted to detect dislocation of either of said first and second end portions, such that, upon detecting said dislocation, said sensor means sends a detection signal to said control unit; and a guide roller mechanism for guiding either of said first and second base materials in a direction orthogonal with said sewing direction in which said first and second base materials are sewn together by said sewing machine, said guide roller mechanism being electrically connected with said sensor means and including:

a guide means for separating said first base material from said second base material and guiding each of said first and second materials along said sewing direction;

a guide roller means;

a rotation drive means for causing rotation of said guide roller means; and a transfer means for transferring said guide roller means toward and away from said setting area of said table, with such an arrangement that, responsive to a signal sent from said control unit which has received said detection signal, said guide roller mechanism is operated such that said transfer means works to transfer said guide roller means toward and away from said setting area, while at the same time, said rotation drive means works to cause rotation of said guide roller means in one of normal and reverse directions so as to cause displacement of said either of said first and second base materials in the direction orthogonal with said sewing direction, whereby said either of said first and second end portions is returned to a fixed point in said sensor means, whereby both said first and second base materials are sewn together along the respective end portions thereof, with the constant margin given between the seam and the outer contours of said first and second end portions.

2. The automated sewing device as claimed in claim 1, wherein said guide means comprises a guide element extending toward said sewing needle of said sewing machine, said guide element having a body of generally inverted-U-shaped cross-section and a through-hole defined therein, thereby allowing said first base material to be guided in and along said through-hole in said sewing direction, while allowing said second base material to be guided upon said body of the guide element in said sewing direction.

3. The automated sewing device as claimed in claim 1, wherein said control means further includes an end abutment member provided adjacent to said sewing needle, said end abutment member having a vertical surface against which said first and second end portions of said first and second base materials are to be abutted, thereby guiding both said first and second end portions toward said sewing needle.

4. The automated sewing device as claimed in claim 2, wherein said end portion of said first base material is rectilinear, whereas said end portion of said second material is curved, wherein said guide means comprises a rectilinear guide element extending rectilinearly toward said sewing needle of said sewing machine, said guide element having a rectilinearly extending body of generally inverted-U-shaped cross-section and a rectilinearly extending through-hole defined therein, thereby allowing said first base material to be guided in and along said rectilinearly extending through-hole in said sewing direction, while allowing said second base material to be guided on and over said rectilinearly extending body of the rectilinear guide element in said sewing direction.

5. The automated sewing device as claimed in claim 1, wherein said rotation drive means comprises a rotation motor having a rotary shaft, wherein said guide roller means comprises one guide roller fixed to said rotary shaft, and wherein said transfer means comprises a vertical cylinder having a cylinder rod on which said rotation motor is fixed.

6. The automated sewing device as claimed in claim 1, wherein said sensor means is of a channel cross-section having an upper portion, a lower potion and an opening side defined between said upper and lower portions, said sensor means including a pair of optical detection elements which are respectively fixed on said upper and lower portions, thereby allowing said end portion of said either of said first and second base materials to be inserted into the opening side thereof and movably positioned between said pair of optical detection elements.

7. The automated sewing device according to claim 5, wherein said one guide roller has a serrated peripheral portion.

8. The automated sewing device as claimed in claim 1, wherein said sensor means comprises: a first sensor means adapted to detect dislocation of said first end portion of said first base member; and a second sensor means adapted to defect dislocation of said second end portion of said second base member, wherein said guide means is provided at said setting area on said table in proximity to said sewing needle, said guide means including a plate element having an upper surface defined above said table so that a space is defined between said upper surface and said table, thereby allowing said first base material to be guided within said space in said sewing direction, while allowing said second base material to be guided upon said upper surface of the plate element in said sewing direction, wherein said first sensor means is provided in said space and said second sensor means is provided on said upper surface of the plate element, wherein said rotation drive means comprises: a first rotation motor connected with said first guide roller; and a second rotation motor connected with said second guide roller, wherein said transfer means comprises a first cylinder connected with said first rotation motor and a second cylinder connected with said second rotation motor, wherein a hole is formed in said table at said setting area in vicinity of said sewing needle, wherein said first guide roller is disposed under said table and below said hole, and wherein said second guide roller is disposed above said plate element.

9. The automated sewing device according to claim 8, wherein said first end portion of said first base material is curved concavely, wherein said second end portion of said second base material is curved convexly, wherein said first sensor means comprises one sensor adapted to detect dislocation of the thus-concavely-curved first end portion, whereas said second sensor means comprises a pair of spaced-apart sensors adapted to detect dislocation of the thus-convexly-curved second end portion.

* * * * *